United States Patent [19]

Mengel

[11] Patent Number: 4,692,058

[45] Date of Patent: Sep. 8, 1987

[54] APPARATUS AND METHOD FOR REMOVING PAVEMENT

[75] Inventor: William F. Mengel, Custer, Wis.

[73] Assignee: F. F. Mengel Company, Custer, Wis.

[21] Appl. No.: 752,686

[22] Filed: Jul. 8, 1985

[51] Int. Cl.[4] ..... E01C 23/12

[52] U.S. Cl. ..... 404/72; 404/90; 404/133; 299/37; 241/271

[58] Field of Search ..... 404/72, 75, 90, 91, 404/133; 299/36, 37; 241/270, 271, 283

[56] References Cited

U.S. PATENT DOCUMENTS

| | | | |
|---|---|---|---|
| 2,768,794 | 10/1956 | Putnam | 299/36 |
| 4,309,126 | 1/1982 | Pfaff | 404/90 |
| 4,560,207 | 12/1985 | Ettefield et al. | 299/36 |

*Primary Examiner*—Stephen J. Novosad
*Assistant Examiner*—William P. Neuder
*Attorney, Agent, or Firm*—Lowe, Price, LeBlanc, Becker & Shur

[57] ABSTRACT

An acute-angled wedge, wider than pavement to be broken up and removed, is forced under the pavement to exert a force to lift it off the underlying ground. A heavy, pivoted, and preferably hydraulically driven hammer hits the pavement above the front edge of the wedge and cracks the pavement at every few inches of its length which then slides over the wedge and successive ramps to a second hammer. This second hammer, also preferably hydraulically driven, has a saw-tooth impact surface profile which renders the cracked pavement and any tensile reinforcement material therein into smaller pieces. These smaller pieces are collected into a hopper for periodic transfer to external transportation means, such as a front-end loader, for ultimate disposal. As pavement is removed and the apparatus moves on, the ground left in its trail is substantially in a condition to immediately receive replacement pavement.

20 Claims, 3 Drawing Figures

APPARATUS AND METHOD FOR REMOVING PAVEMENT

TECHINCAL FIELD

This invention relates to apparatus and a method for continuously breaking up and removing road pavement to leave a substantially even ground surface for the placement of new pavement thereon.

BACKGROUND OF THE INVENTION

Changing circumstances and developing needs often require the replacement of existing pavement by new and, generally, sturdier and wider pavement. This is particularly true where secondary roads between population centers must be replaced by multi-lane highways over many miles.

Numerous forms of pavement breaking apparatus have been proposed and, in fact, are in use today. Such apparatus ranges from the simple pick and shovel, through pneumatic or hydraulic jack-hammers and front end loaders, to multi-bladed power-driven blades that essentially chop up existing pavement in place to serve as the base for a new road with a fresh pavement.

A need exists, however, for apparatus that can in one pass rapdily and economically break up the entire width of an existing pavement, remove the debris (including typical steel reinforcement included therein), and leave the ground substantially ready to receive the new pavement immediately thereafter.

DISCLOSURE OF THE INVENTION

Accordingly, it is an object of this invention to provide apparatus for continuously, rapidly, and economically breaking up the entire width of an existing pavement for removal thereof.

It is another object of this invention to provide apparatus for continuously, rapidly, and economically breaking up the entire width of an existing pavement, including any steel reinforcement therein, into small pieces of predetermined size for removal thereof.

It is yet another object of this invention to provide apparatus for continuously, rapidly, and economically breaking up the entire width of an existing pavement, including any reinforcement steel therein, into smaller pieces of predetermined size elevated to a preselected height for collection and periodic disposal thereof to external transportation means.

It is yet another object of this invention to provide apparatus for continuously, rapidly, and economically breaking up the entire width of an existing pavement, and removing the debris, including typical steel reinforcement included therein, and to leave the ground underneath substantially ready to receive new pavement immediately thereafter.

It is a further object of this invention to provide a method for continuously, rapidly, and economically breaking up the entire width of an existing pavement for removal thereof.

It is an even further object of this invention to provide a method for continuously, rapidly, and economically breaking up the entire width of an existing pavement and removing the debris, including typical steel reinforcement included therein, in the form of smaller pieces of predetermined size collected at a preselected height for convenient transfer therefrom to external transportation means for ultimate disposal.

It is also an object of this invention to provide a method for continuously, rapidly, and economically breaking up the entire width an existing pavement, disposing of the debris in the form of smaller pieces of predetermined size, and leaving the ground substantially ready to receive new pavement immediately thereafter.

These and other objects of this invention are achieved in the preferred embodiment by drawing a long acute-angled wedge between the pavement that is to be removed and the ground below, so as to exert a lifting force on the pavement end, and periodically applying downwardly directed impact forces on the top surface of the pavement to crack through the entire thickness of the pavement and cause the broken pavement to slide upwardly on the upper surface of the wedge. One or more sequentially connected ramps of increasing height may be pulled behind the wedge so as to provide a substantially continuous inclined surface for the broken pavement to slide up to a predetermined height, where a vertically reciprocating power driven hammer having a saw tooth face is applied to the broken pavement over rigid horizontal bars so as to render the broken pavement into smaller pieces of predetermined size to fall below under the force of gravity. These broken pieces may be collected in a hopper from which they may be disposed at a predetermined height and in a manner most convenient for subsequent reception by external transportation means for ultimate disposal thereof. It is convenient to support the first hammer on pivoted arms carried by the first of the successive ramps that follow the wedge. A second ramp may conveniently be used to house a diesel engine attached to a hydraulic pump to provide hydraulic pressure to operate the pavement breaking hammers. In the preferred embodiment, the wedge slides along the ground and lifts the pavement, while the ramps slide behind the wedge on flat horizontal load-bearing ski-like surfaces, so that as the apparatus proceeds forward and removes old pavement the ground that is left behind has a substantially smooth firm surface suitable for the reception of new pavement thereon. It is convenient to have the wedge a few feet wider than the maximum width of the pavement that is to be removed, so as to ensure complete removal thereof and to leave behind a somewhat wider surface to receive the replacement pavement. The wedge may conveniently be made of sheet steel and provided with internal partitions such that the hollow spaces so defined within may be selectively filled with concrete to obtain a solid and predetermined weight for the wedge to ensure stable operation thereof.

BRIEF DESCRIPION OF THE DRAWINGS

Like elements and parts of elements are identified by the same numbers in all the drawings and in the specification.

BEST MODE FOR PRACTICING THE INVENTION

The principal purpose of the apparatus of this invention is, in effect, to lift the free end of an extended length of existing pavement, which creates an air space between the bottom of the existing pavement and the ground to enhance cracking of the pavement by applying a downwardly directed impact force across the entire width of the pavement of sufficient magnitude to crack through the entire thickness of the pavement. As more and more of the pavement is so cracked up, the apparatus advances and, in doing so, ramps the broken pavement to a suitable height where it is broken further into much smaller pieces, for collection in a hopper for disposal into trucks or front end loaders for removal from the site.

Figure 1:
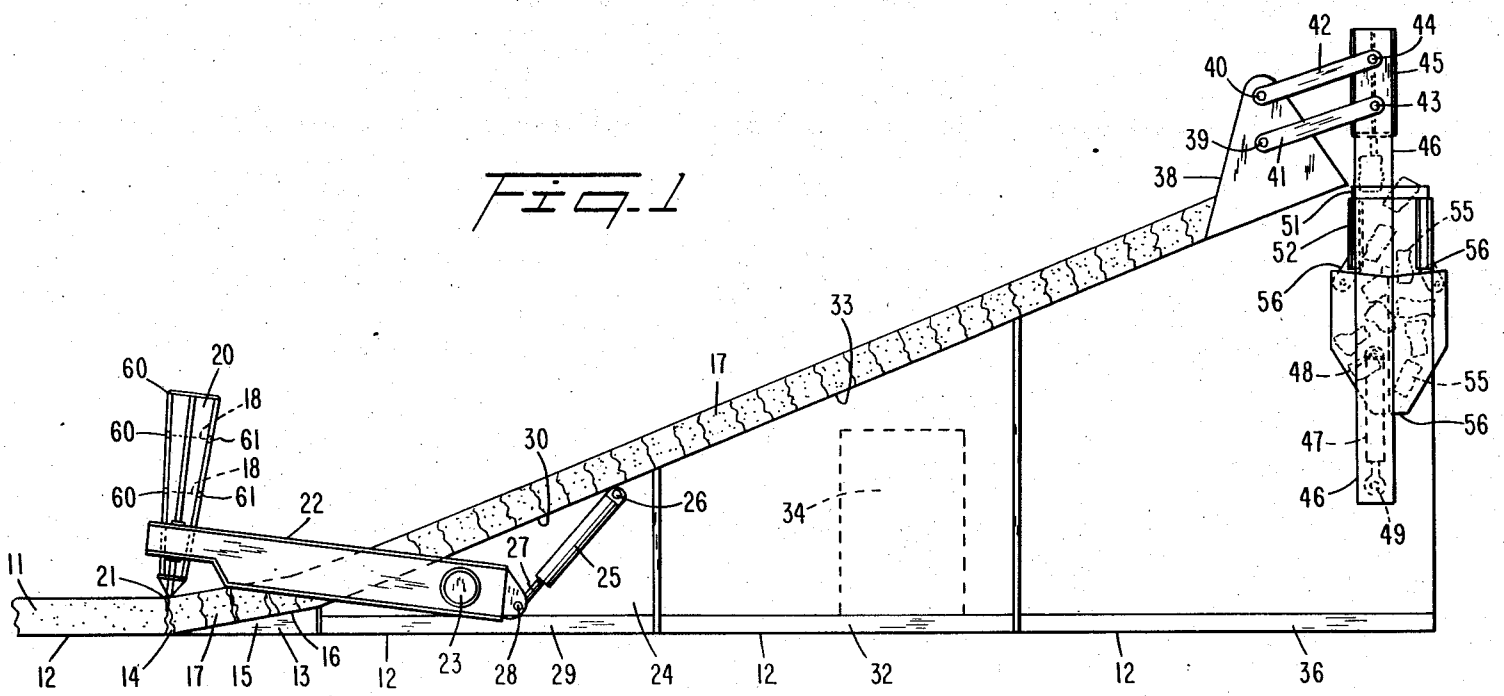
FIG. 1 is an elevation view, in partial cross-section, showing schematically the principal elements of the apparatus of this invention.

As best seen in FIG. 1, an existing road pavement 11 rests in contact with the underlying ground surface 12. A single long metal wedge 15 is introduced under the free end of pavement 11 at its acute-angled front end which includes the angle, where is preferably in the range 15°–20°. Wedge 13 is preferably a few feet longer than the width of the existing pavement which is to be broken up and removed. Wedge 13 is to be forcibly moved forward under existing pavement 11 so as to continually exert an upwardly lifting force on it with respect to ground 12. Lower surface 15 of wedge 13, therefore, rests on and slides along the freshly uncovered ground as the broken pavement slides upon and is supported by upper surface 16. For a typical pavement width of 24 feet it may be convenient to have the wedge 13 approximately 27 feet long and having the maximum height H approximately 5 to 6 inches. Although the details are omitted from FIG. 1 for the sake of simplicity, wedge 13 is provided on either end thereof with conventional connection means for the application of sufficient forwardly directed force to enable it to be drawn under the existing pavement.

A heavy hammer head 20 is provided with a hard and relatively narrow lower edge 21 at which it impacts the pavement. Hammer head 20 is preferably internally partitioned, e.g., by one or more plates 18, so that a predetermined amount of water may be introduced into the compartments so formed to alter the weight of the hammer. Thus thicker and harder pavement will require a heavy hammer, i.e, one with a substantial amount of water added, whereas a thinner pavement may be readily broken up by a relatively lighter hammer. In addition to this facility to rapidly change its weight to alter its impact force, this hammer allows the user to remove all the water and thereby considerably lighten the hammer for easier transportation of the apparatus between sites. Each compartment of hammer 20 is provided with an air bleeder hole 60 near its top and a water injection/removal valve 61 near its bottom.

Hammer head 20 is attached to and supported by a pair of substantial arms 22, one on either side, which are themselves pivoted about pivots 23 supported by a ramp 24 located immediately behind wedge 13. The ends of arms 22 away from hammer 20 are each provided with a pivot 28 to which is attached a hydraulic piston 27 which slides inside a cylinder 25 pivoted at one end by pivot 26 also supported by ramp 24. Ramp 24 is carried by longitudinal sliding members 29 whose lower surface slide on ground 12 to follow wedge 13, as wedge 13 is pulled forward under the existing pavement 11.

As illustrated in FIG. 1, broken pavement 17, formed from existing pavement 11 by successive blows of hammer 20, slides upward on top surface 16 of wedge 13 and then is supported by and slides further to rise higher on top surface 30 of ramp 24. At this stage the steel reinforcement, if any, in pavement 11 is not necessarily broken completely, so that the successive broken segments 17 remain somewhat flexibly attached to each other as they rise above the ramp. As a result of this, it is generally not necessary to provide guide edges on either sides of the ramp to retain the broken pavement thereupon. Any dirt scraped up by the wedge 13 either falls back on the road and is removed with broken pavement for disposal therewith.

In the preferred embodiment, against as best seen in FIG. 1, a second ramp segment 31 resting on sliding member 32 and having an upper inclined surface 33 of the same inclination as ramp 24 is drawn behind ramp 24 as the apparatus proceeds forwardly. It is convenient to utilize ramp 31 as a support means for, typically, a diesel engine which drives a hydraulic pump (not shown for simplicity) which provides the hydraulic power necessary to operate the cylinder piston arrangement that drives hammer 20 and, as discussed below, a second hammer to further render the broken pavement into smaller pieces. The broken pavement 17 therefore continues to rise to greater heights as it slides further onto the second ramp 31.

In the preferred embodiment, as shown in FIG. 1, a third ramp segment 35 resting on horizontal sliding members 36 on ground 12 is drawn behind the second ramp 31. Ramp 35 is provided with an upper inclined surface 37 which coacts with inclined surfaces 33 of ramp 31 and 30 of ramp 24, respectively, to provide a substantially continuous surface upon which the broken pavement 17 continues to slide and rise. Adjacent the rear end of the top surface of ramp 35 are provided trunnions 38, one on either side, to carry pivot pins 39 and 40 to which are attached parallel links 41 and 42 respectively. At the distal ends of links 41 and 42 are provided pins 43 and 44, respectively, which are attached to and support a second pavement breaking hammer 45 provided with a specially shaped lower impact face 50. Because of the parallel disposition of links 41 and 42, hammer 45 therefore moves substantially in an up and down reciprocal motion under the action of vertical forces transmitted via arms 46, again one on either side. Vertical arms 46 are attached via pins 49 to hydraulic piston and cylindrical combinations 47 which are attached to ramp 35 by pins 48, one on either side. The hydraulic mechanism 47, as is mechanism 25, is connected to the hydraulic pump driven by the diesel engine power source 34 which is itself conveniently carried inside ramp 31.

Immediately below hammer head 45 is a plurality of strong cross bars 52 supported on transverse beams 52 which are longer than the width of the pavement being removed. Therefore, as seen in FIG. 1, broken pavement segments are broken further into smaller pieces which may fall between cross bars 51 and beams 52. Beams 52 also support by links 56 a hopper 57, shown in partial section, which receives the broken pieces 55 and any dirt scraped up by the wedge 13 for subsequent disposal through an opening 56 which is located at a height suitable for transfer of broken pieces 55 therefrom to an external transportation means.

Figure 2:
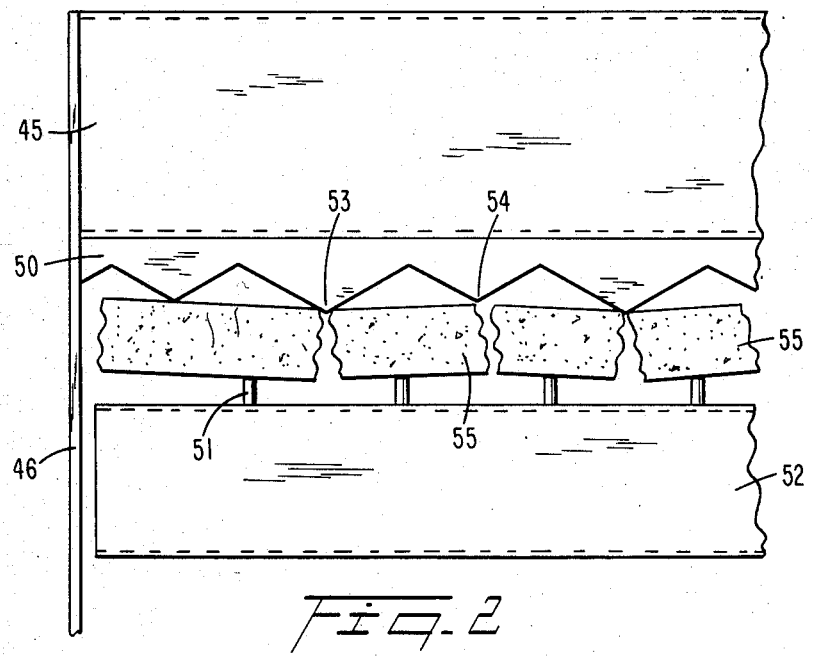
FIG. 2 is a partial vertical elevation view showing the disposition of the saw-tooth head of the second hammer breaking up the previously broken pavement material.

As best seen in FIG. 2, hammer 45 is provided with a particularly shaped lower edge 50 which has a saw tooth profile comprised of generally shallow triangular teeth of two different heights disposed in an alternative array. Thus, teeth 53 are higher above their respective bases than are teeth 54. The teeth 53 and 54 and cross bars 51 are spaced and sized as to cause teeth 53 to impact the broken pavement 17 in such a manner as to cause it to break up into smaller pieces 55 which fall between cross bars 51 under gravity when the upward motion of hammer 45 permits them to do so. Hammer 45 moves reciprocally up and down in a double action motion, actuated by a double action hydraulic cylinder and piston arrangement 47. This ensures that each broken segment 17 of pavement 11 that reaches hammer 45 is subjected to a plurality of blows of sufficient intensity as to cause breakage not only of the concrete or other compression load bearing material of the pavement but also of any tensile load bearing reinforcement material, e.g., steel rebars, that may be located within the pavement.

As will be clear to persons skilled in the art, depending on the thickness, rigidity, and overall strength of pavement 11, it will be necessary for the operator of this apparatus to exercise some judgement as to the speed with which the apparatus is advanced into pavement 11. Likewise, it may be preferable to allow the operator to select the rate at which hammers 20 and 45 operate on the pavement. Finally, in the preferred embodiment which is provided with hopper 57, it may be convenient to periodically halt the forward progress of the apparatus to empty hopper 57 onto a truck bed or a front end loader which is placed below the hopper opening 56. As will be clear from this discussion, ramp 35 will therefore have side walls but not necessarily an end wall, so that a front end loader may, in effect, advance into ramp 35 so as to be under opening 56.

As will be clear from the preceding discussion, as pavement 11 is broken up, initially by hammer 20 impacting generally in front of wedge 13 and hammer 45 which further renders the pavement into much smaller pieces 55, the broken pavement is removed entirely. Under the lower surfaces of wedge 13 and ramps 24, 31, and 35, therefore, the ground surface that is left behind will be substantially smooth and level to a width greater than that of the pavement which has been removed. This should facilitate virtually immediate deposition thereon of new material to create a replacement pavement, which may be of the width of wedge 13. Therefore, by appropriate selection of the length of wedge 13 it is possible to not only remove old pavement 11 but to create a prepared ground surface of greater width for the replacement pavement.

In operating this apparatus, therefore, one end of existing pavement 11 would have to be available for the introduction of the front edge 14 of wedge 13. Once the relatively thin loading edge 14 is introduced under the pavement, and the assorted ramps are attached to wedge 13 to follow it in sequence as described above, it is convenient for a tractor resting on the unbroken surface of pavement 11 to pull on wedge 13 and the succession of attached ramps in a forward direction at a controlled pace. As will be understood by persons skilled in the art, conventional control means as are normally used for such equipment may be utilized with this apparatus so that the operator of the tractor may easily control the pace and the intensity with which hammers 20 and 45 operate on the pavement to be removed.

Other embodiments in which the various ramps are supported partially or totally on wheels or tracks of conventional kind will occur readily to persons skilled in the art, and these are understood to be within the scope of this invention.

Wedge 13 is preferably made of welded sheet steel so that its lower surface 15 and upper surface 16 form an acute angle. Transverse partitions, with apertures therein (not shown in FIG. 1 for simplicity), are provided to stiffen and strengthen the wedge mechanically. It may be desirable to fill wedge 13 with concrete to increase its weight and stability in operation and to leave behind a firm smooth ground surface.

Figure 3:
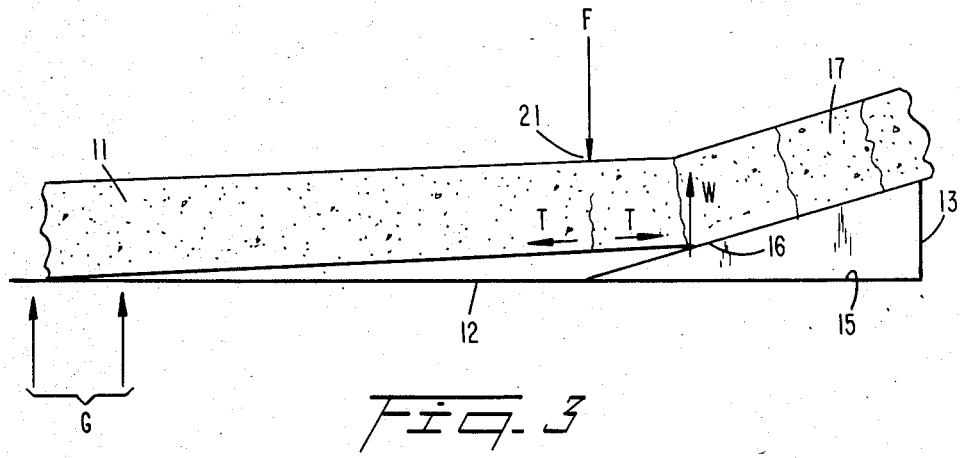
FIG. 3 is a force diagram schematically depicting the forces generated by the downward impact of the first pavement breaking hammer.

FIG. 3 illustrates in simple schematic terms how ground support forces G exert a distributed upward force on pavement 11 while a single upward force W is exerted along a line formed by the contact of the lower corner of pavement 11 touching the upper surface 16 of wedge 15. When the lower edge 21 of hammer 20 hits the top surface of pavement 11 it creates a high impact force F, the result of which is to put the lower portion of pavement 11 into tension, as indicated by forces T shown as directed in both directions away from a crack forming under the impact force F. In this very important respect, therefore, the apparatus and method taught in this invention differ significantly from those taught in the prior art. The prior art, for example, has numerous examples of sharp bladed impact tools which merely impact on the top of pavement as it lies, in place resting on the ground below, to break up the pavement by a combination of compression and shear forces only. This invention, by contrast, utilizes the fact that cement, concrete, and the like which form the bulk of road pavement, do not have significant strength in tension. The deliberate forcing of wedge 13 under the old pavement ensures that tensile forces at the bottom surface thereof are aggravated by the impact of hammer 20. Once material of this nature is cracked up, subsequent impacts by teeth 53 of hammer 45 between strong rigid supporting cross bars 51 causes easy breakup of successive small portions of the pavement 11, i.e., portions 17, to break up into much smaller pieces 55. Note also that the repeated impact of teeth 53 and, in time, teeth 54, over cross bars 51 will cause sufficient concentration of shear force between cross bars 51 to cause breakage of reinforcement material located within the pavement being broken up.

Modifications may be made to both the apparatus and the method disclosed herein without departing from the scope of this invention. Such modifications are therefore understood to be comprehended within this disclosure as limited only by the claims appended below.

What is claimed is:

1. An apparatus for removing road pavement, inclusive of any metal reinforcement incorporated therein, and rendering the same into small pieces for easy disposal thereafter, comprising:

movable pavement lifting means for applying a lifting force to an end of said road pavement substantially across the width of said pavement;

a first movable pavement breaking means, cooperating with said pavement lifting means, for applying a downwardly directed impact force substantially across the width of said pavement, at a predetermined position adjacent a forward end of said pavement lifting means forwardly of said pavement end being subjected to said lifting force, for generating resultant tensile forces in the lower portions of said lifted pavement under the applied impact force for breaking said pavement thereby;

movable ramp means cooperating with said pavement breaking means, substantially supported by and moving generally over the area from which said pavement has been broken by said first pavement breaking means, for lifting said broken pavement and any said metal reinforcement incorporated therein by movement behind said movable pavement lifting means; and a second movable pavement breaking means, cooperating with said ramp means and positioned adjacent the highest point to which said ramp means lifts said broken pavement, for rendering said broken pavement and any said metal reinforcement incorporated therein into smaller pieces of predetermined size.

2. An apparatus as described in claim 1, wherein:

said pavement lifting means comprises an acute angled wedge inserted between said pavement end and the ground below, said lifting force on said pavement end being generated by moving said wedge further under said pavement.

3. An apparatus as described in claim 1, further comprising:

a movable power source for powering said first and second pavement breaking means.

4. An apparatus as described in claim 3, further comprising:

tractor means for moving said pavement lifting means, said first pavement breaking means, said ramp means, said second pavement breaking means and said power source, with respect to said road pavement for breaking up thereof.

5. An apparatus as described in claim 4, further comprising:

movable broken pavement collection means, connected with said ramp means, for collecting said smaller pieces of broken pavement rendered by said second pavement breaking means.

6. An apparatus as described in claim 4, wherein:

said ramp means comprises a plurality of sequentially connected ramp segments.

7. An apparatus as described in claim 5, wherein:

a first one of said plurality of ramp segments is located next after said pavement lifting means and supports said first pavement breaking means.

8. An apparatus as described in claim 7, wherein:

said first pavement breaking means comprises an arm pivotally supported by said first ramp segment intermediate a forward end and a rear end of said arm, a hammer head attached to said forward end, and a hydraulic piston and cylinder drive pivotally attached to said second end, said drive being powered by said power source.

9. An apparatus as described in claim 8, wherein:

said hammer head comprises a plurality of lengthwise oriented compartments, each provided with a valve and an air-bleed aperture, for filling said hammer head with water to cause said hammer head to attain a predetermined weight.

10. An apparatus as described in claim 8, wherein:

said second pavement breaking means is supported by one of said plurality of ramp segments and is actuated by a double acting hydraulic piston and cylinder drive powered by said power source.

11. An apparatus as described in claim 10, wherein:

said power source is carried by one of said plurality of ramp segments.

12. An apparatus as described in claim 4, wherein:

said second pavement breaking means comprises a vertically reciprocating hammer whose striking face has a predetermined saw tooth pattern in which teeth of a first height alternate between teeth of a lesser height, rigid cross bars in a predetermined distribution onto which pavement broken by said first pavement breaking means is ramped to be positioned under said vertically reciprocating hammer such that said teeth of said hammer face strike said broken pavement intermediate said cross bars to render said broken pavement into pieces small enough to fall between said cross bars.

13. Apparatus as described in claim 8, wherein:

said second pavement breaking means comprises a vertically reciprocating hammer whose striking face has a predetermined saw tooth pattern in which teeth of a first height alternate between teeth of a lesser height, rigid cross bars in a predetermined distribution onto which pavement broken by said first pavement breaking means is ramped to be positioned under said vertically reciprocating hammer such that said teeth of said hammer face strike said broken pavement intermediate said cross bars to render said broken pavement into pieces small enough to fall between said cross bars.

14. Apparatus as described in claim 13, wherein:

said pavement collection means comprises a hopper located below said cross bars to receive said pieces falling therebetween, said hopper having a closeable discharge opening disposed at a predetermined height and orientation.

15. Apparatus as described in claim 2, wherein:

said wedge is hollow and partitioned and is weighted by concrete poured therein.

16. A method of breaking up and removing road pavement, inclusive of any metal reinforcement therein, comprising the steps of:

introducing an acute angled hollow wedge between an end of said road pavement and the ground below, said wedge being oriented transverse to said road and extending beyond the width of said road pavement on both sides thereof;

applying an external force directed to force said wedge forwardly under said pavement, whereby an upwardly directed force is exerted on said pavement end by an upper surface of said wedge;

applying a downwardly directed impact force substantially across the width of said pavement a predetermined distance forward of said pavement end while said wedge is exerting said upwardly directed force thereon, so that resultant tensile forces are generated in the lower portions of said lifted pavement under the applied impact force whereby a portion of said road pavement breaks and is supported by said wedge; and repeating said application of downwardly directed impact force while maintaining said external force on said wedge, whereby additional portions of said road pavement are broken and previously broken portions are caused to slide further up along said upper surface of said wedge.

17. The method described in claim 16, comprising the further step of:

moving at least one ramp surface behind said wedge to provide a substantially continuous surface for said broken pavement to slide onto a greater height with respect to said ground.

18. The method as described in claim 17, comprising the further step of:

applying downwardly directed impact forces at predetermined points onto said broken pavement adjacent a rearward end of said ramp surface, whereby said broken pavement is rendered into smaller pieces.

19. The method of claim 18, comprising the further step of:

collecting predetermined amounts of said smaller pieces as they are produced, for periodic transfer thereof at a predetermined height to external removal means for subsequent disposal.

20. The method of claim 18, comprising the further step of:

filling said wedge to a predetermined extent to weight it for smoothly packing ground beneath its path of motion.

* * * * *